US005761758A

United States Patent [19]

Mellon

[11] Patent Number: 5,761,758

[45] Date of Patent: Jun. 9, 1998

[54] FLEXIBLE JACK CLEANING TOOL

[76] Inventor: William H. Mellon, 2204 Oakwood, Portland, Tex. 78374

[21] Appl. No.: 705,140

[22] Filed: Aug. 29, 1996

[51] Int. Cl.[6] ..... A47L 25/00

[52] U.S. Cl. ..... 15/104.001; 451/524; 451/557

[58] Field of Search ..... 15/104.03, 104.05, 15/104.001, 236.01; 451/524, 557

[56] References Cited

U.S. PATENT DOCUMENTS

| | | | |
|---|---|---|---|
| 1,002,468 | 9/1911 | Strangman | 15/104.001 |
| 1,427,503 | 8/1922 | Wake | 451/524 |
| 2,099,030 | 11/1937 | Morrison | 15/104.001 |
| 2,359,607 | 10/1944 | Bashara | 15/236.01 |
| 2,744,279 | 5/1956 | Heber . | |
| 2,806,333 | 9/1957 | Head | 451/557 |
| 3,956,858 | 5/1976 | Catlin | 451/557 |
| 4,263,692 | 4/1981 | Gremillion . | |
| 4,733,678 | 3/1988 | Bolois . | |
| 5,273,425 | 12/1993 | Hoagland | 451/524 |

FOREIGN PATENT DOCUMENTS

| | | | |
|---|---|---|---|
| 0196818 | 7/1938 | Switzerland | 15/104.001 |
| 790266 | 2/1958 | United Kingdom | 15/104.001 |
| 1512733 | 6/1978 | United Kingdom | 451/557 |
| 2244641 | 12/1991 | United Kingdom | 15/104.03 |

*Primary Examiner*—Randall Chin
*Attorney, Agent, or Firm*—George S. Gray

[57] ABSTRACT

A flexible cleaning tool for cleaning corrosion from the contact arms and barrel of electrical jacks of the type frequently used in guitar amplifiers and public address systems. A low density polyethylene shaft is inserted into the jack and manipulated by moving the handle, whereby the flexibility of the shaft allows the shaft to bear upon the jack contact arms and jack barrel interior in a manner which is highly conducive to efficient and thorough cleaning. The dislodged corrosion attaches to the shaft allowing the corrosion to be transported from the interior of the jack enclosure where it can be easily washed from the shaft.

14 Claims, 4 Drawing Sheets

FLEXIBLE JACK CLEANING TOOL

BACKGROUND

This invention relates generally to the removal of corrosion from the contact arms and the barrel interior of electrical jacks of the type typically found in guitar amplifiers, public address systems, etc.

In an ordinary electrical jack a metallic plug is inserted into the barrel of the jack until the shoulder of the plug bears upon the exterior face of the jack. The shaft of the plug will then be in electrical contact with the end of one or more of the jack contact arms, while the shaft of the plug is in electrical contact with the interior surface of the jack barrel. The jack contact arms and barrel are metallic and subject to oxidation which results in the accumulation of corrosion on their respective contact surfaces. Other unwanted materials, such as dirt, etc. may also be deposited on such surfaces from the electrical plug, etc.

The removal of such corrosion and other materials is difficult because the typical electrical jack installation results in the contact arms being contained in a cabinet enclosure which greatly reduces available access. Although some devices are available for cleaning the contact arm without entering the enclosure, none are available which provide an optimum level of cleaning efficiency. This is due in large part to the rigidity of the cleaning tool and the nature of the cleaning surface.

The file like action of a rigid and metallic shaft surface is likely to cause excessive wear on the jack, particularly with respect to the jack contact arms. Furthermore, a rigid tool shaft, even with significant manipulation, is unlikely to effectively bear upon an acceptably large contact patch with the jack barrel interior.

Additionally, the rigid and metallic shaft surface is unable to capture any significant amount of the removed corrosion for removal from the enclosure interior, leaving the same to accumulate on or near other electrical components within the enclosure.

What is needed is a jack cleaning tool with a flexible shaft, which has an appropriate exterior surface for cleaning the jack contact arms and jack barrel interior, and for removing the corrosion from the enclosure.

SUMMARY OF THE INVENTION

My invention is a jack cleaning tool with a flexible shaft made of low density polyethylene, a material which is optimal for the non-abrasive removal of corrosion and other unwanted materials from the metallic surfaces of the contact arm and barrel of typical electrical jacks, and for transporting such materials from within the enclosure containing the jack.

When the shaft is fully inserted into the barrel, the exterior surface of the shaft will bear upon the tip(s) of the arm(s) at the apex jack contact. With respect to each jack contact arm tip, when the handle is rotated the exterior surface of the shaft removes corrosion as it moves along the contact arm tip apex. Substantially all of such corrosion attaches to the exterior surface of the shaft and is removed from the enclosure interior when the shaft is pulled from the barrel.

The flexibility of the shaft also allows substantial portions of the shaft to bear upon the interior surface of the jack barrel in such a manner that significant pressure can be applied to the resulting contact patch by proper manipulation of the handle. As before, the motion of the exterior surface of the shaft causes corrosion to be removed from the interior surface of the jack barrel, and to become attached to the exterior surface of the shaft.

When removed the shaft can itself be cleaned, without loss of shape or integrity, by the use of alcohol or other readily available substances.

The shaft also has a tool tip on the end of the shaft, having a diameter smaller than the shaft diameter which provides a smoother insertion of the shaft by gradually displacing one or more of the jack contact arms as the shaft is inserted. When the length of the tool tip reduction in diameter is extended along the shaft to a point where the tool tip exterior surface bears upon a contact arm tip apex (or a plurality of them), the displacement of the contact arm is reduced accordingly. This may be desirable in situations involving contact arms having a more fragile structure. It can also provide additional cleaning efficiency when the surface of one or more contact arms is positioned at an angle with respect to the path of the shaft as it is inserted.

DESCRIPTION OF THE DRAWINGS

These and other features, aspects, and advantages of the present invention will become better understood with regard to the following description, appended claims, and accompanying drawings where:

FIGS. 1–4 are not to scale, particularly with regard to the relationship between the shaft and the barrel interior. This relationship is depicted in an enhanced manner to illustrate the approximate portions of the barrel interior which are effectively borne upon by the shaft.

DESCRIPTION

Figure 1:
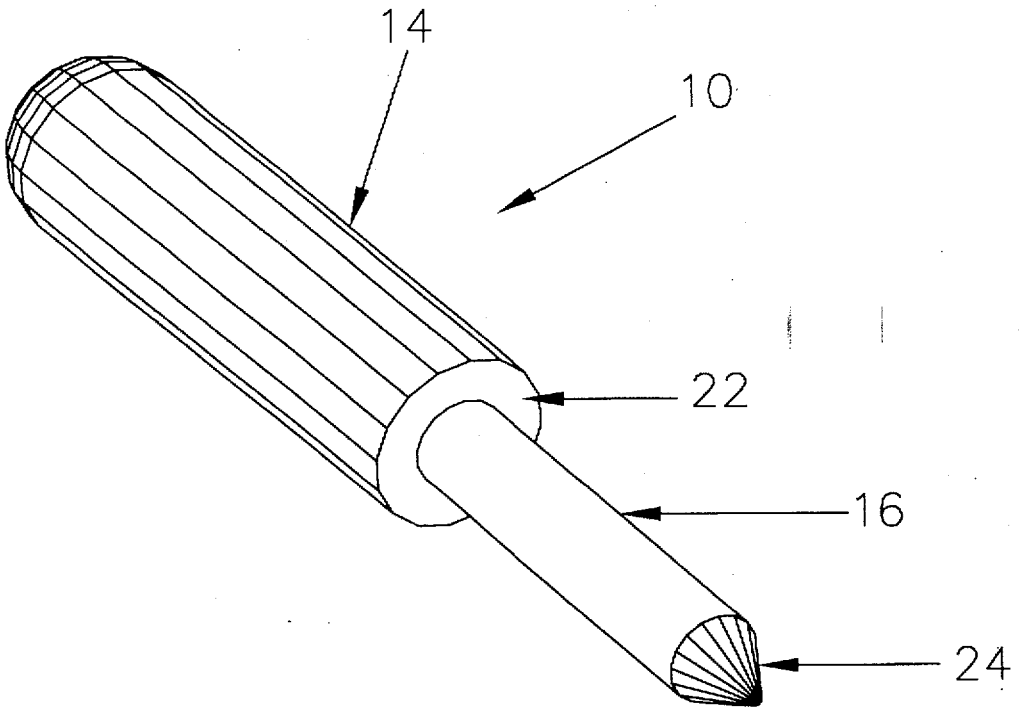
FIG. 1 shows an oblique view of the preferred embodiment of the jack cleaning tool.
Figure 2:
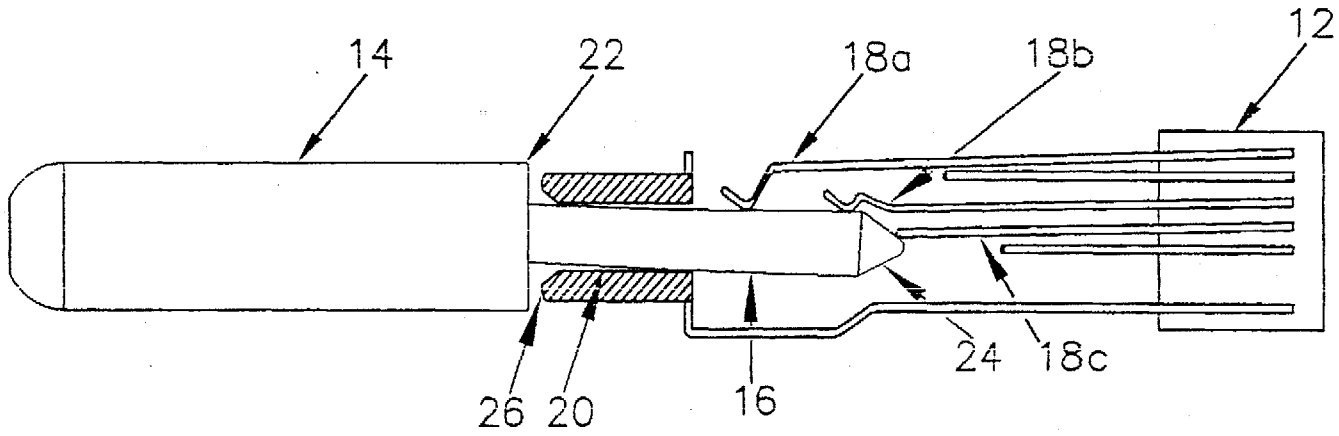
FIG. 2 is a view of the jack cleaning tool inserted completely into a typical electric jack of the type having more than one jack contact arm. The view of the jack is sectional.
Figure 3:
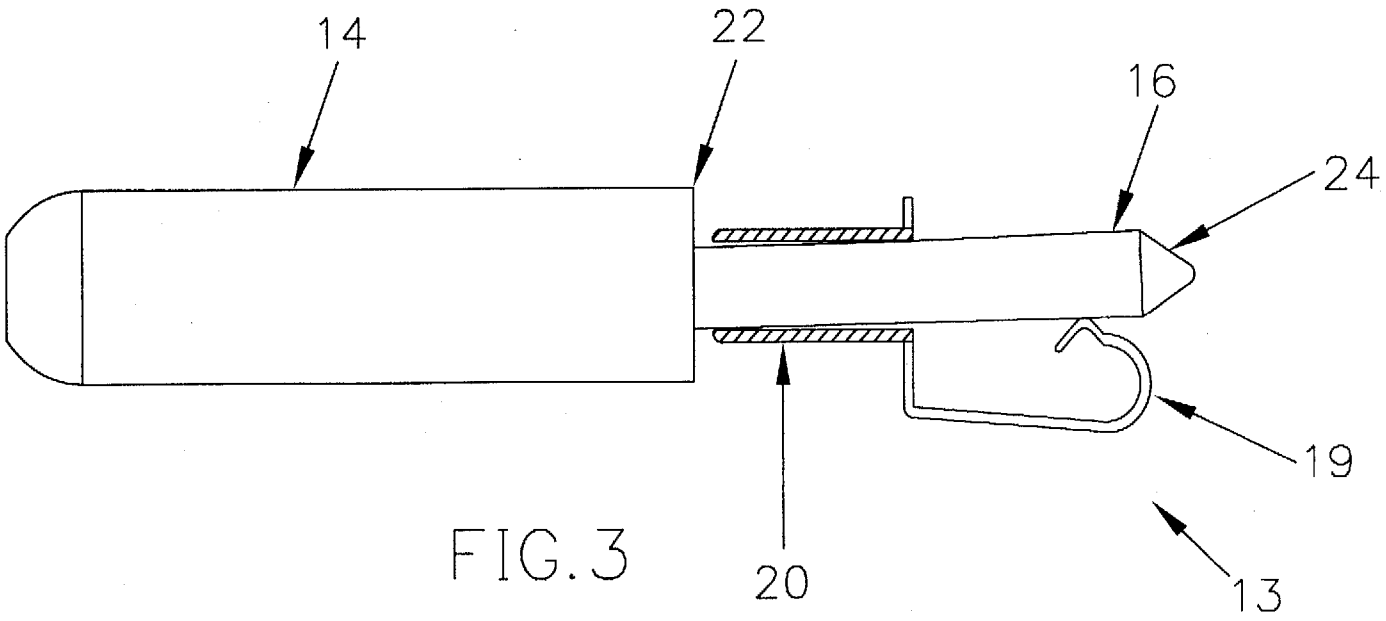
FIG. 3 is a view of the jack cleaning tool inserted completely into a typical electrical jack of the type having a single jack contact arm. The view of the jack is sectional.
Figure 4:
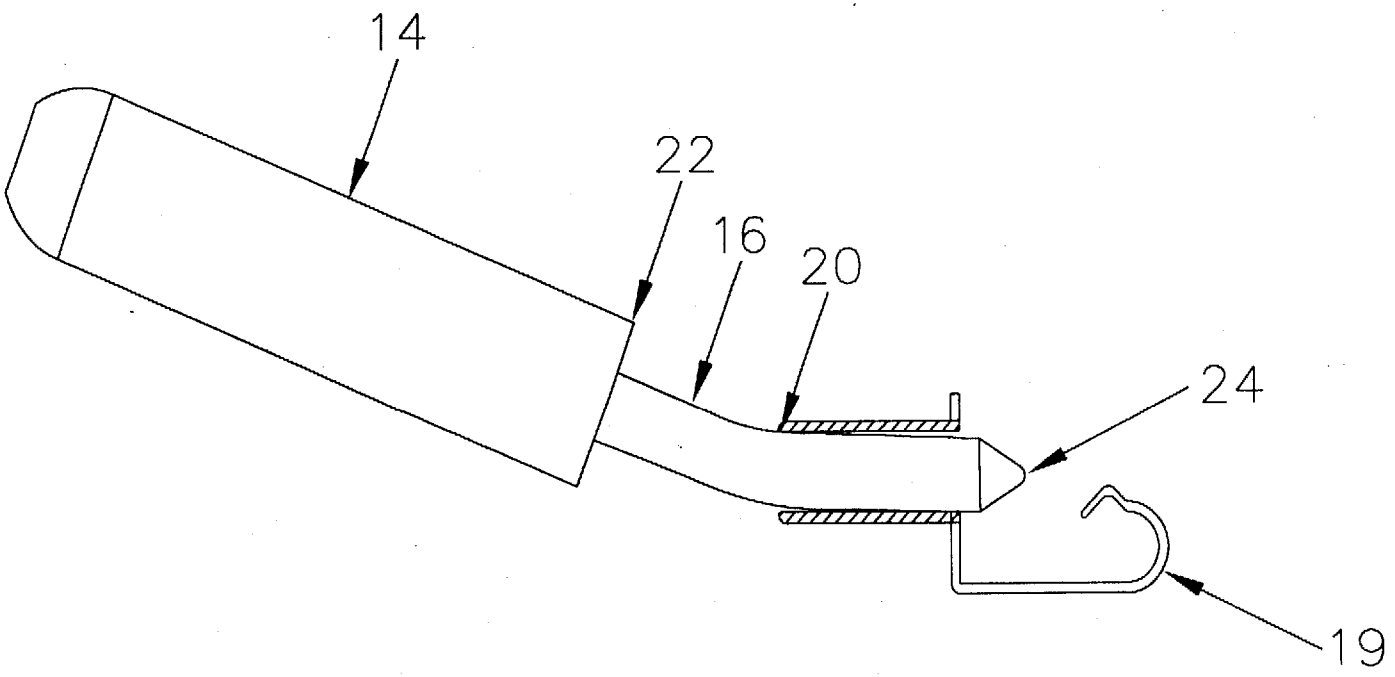
FIG. 4 is a view of the jack cleaning tool inserted partially into the electrical jack of FIG. 3. The view of the jack is sectional.

The preferred embodiment of the jack cleaning tool 10 is depicted in FIGS. 1–4, with FIGS. 2–4 illustrating the manner in which the tool 10 is utilized with respect to typical electrical jacks 12,13. The handle 14 is sized for gripping by hand and can be made of any number of materials, including wood, hard plastics, etc. The flexible shaft 16 is firmly attached to the handle 14, and is made of low density polyethylene (Eastman TENITE Polyethylene 18BOA) in the preferred embodiment, although it is anticipated that some variation in the density will be tolerable. It is further anticipated that the shaft 16 could have a core of a different material. The TENITE referenced herein is identified by Eastman Chemical Company as TENITE Polyethylene 18BOA, Product Identification Number: PLS 18BOA, in its Material Safety Data Sheet bearing Approval Date: 1995-12-02. The product information was provided by Eastman Chemical Company by computer printout dated Aug. 16, 1996. Other materials of substantially similar characteristics could be substituted.

As shown in FIG. 2–4, the shaft 16 is of sufficient length to bear upon the jack contact arms 18*a–b*,19 when the shaft 16 is fully inserted into the jack barrel interior 20. In particular, each jack contact arm 18*a–b,* 19 is borne upon at the apex formed by the two sides of the jack contact arm 18*a–b,* 19 tip. Although not required for the proper operation of the tool 10, the preferred embodiment includes a shoulder 22, which is formed by a reduction in cross-sectional areas of the handle 14 and the shaft 16 at the point at which they are joined. When fully inserted, the shoulder 22, is adjacent the jack exterior face 26.

The preferred embodiment also includes a conical tip 24 on the shaft 16 which eases one or more of the jack contact arms 18*a–b,*19 aside as the shaft 16 is inserted. This improves the insertability of the shaft 16 by allowing it to move smoothly beyond the jack contact arm 18*a–b,*19. Other tool tip 24 configurations could provide similar improvements in insertability, e.g. a rounded end. The conically shaped tool tip 24 will also enhance the cleaning efficiency of the shaft 16 due to the increased surface area contact between the tool tip 24 and surfaces which are angularly positioned with respect to the longitudinal axis of the shaft 16 as it is being inserted. These surfaces include the jack contact arms 18*a–b* in FIG. 2, and the sole contact arm 19 in FIG. 3.

The shaft 16 is also circularly shaped, which allows for more efficient contact with the jack barrel interior 20, particularly when the shaft 16 is bent and moved within the jack barrel interior 20. The circular shape also optimizes the efficiency with which the shaft 16 exterior surface is moved along the contact arm 18*a–b,* 19 tip apex.

Although the present invention has been described in considerable detail with reference to certain preferred and alternate embodiments thereof, other embodiments are possible. Accordingly, the spirit and scope of the appended claims should not be limited to the description of the embodiments contained herein.

Different electrical jacks, e.g. "bantum" jacks, "quarter-inch" jacks, and others, can be cleaned effectively by my device, by mere resizing.

I claim:

1. A cleaning tool for cleaning an electrical jack, the jack having an exterior face and a barrel, the jack barrel having an interior through which an electrical plug is inserted, the jack barrel interior having a diameter, the jack further having a metal contact arm, the jack contact arm having a tip, the jack contact arm tip having two sides forming an apex, the jack contact arm tip apex being in contact with the electrical plug upon insertion, comprising:

(a) a handle; and (b) a flexible, circular shaft, the shaft having a first end attached to the handle, the shaft further having a second end, a length between the shaft first end and the shaft second end, a diameter, and an exterior surface, the shaft diameter being such that the shaft is closely received by the jack barrel, the shaft length being greater than the distance from the jack exterior face to the jack contact arm tip apex, the shaft material being such that, as the shaft second end is inserted in and beyond the jack barrel interior, the shaft second end bears upon the jack contact arm tip and displaces the jack contact arm tip such that the shaft exterior surface moves into contact with the displaced jack contact arm tip apex, the shaft flexibility also allowing the stiffness of the jack contact arm to bend the shaft, the shaft exterior surface material being such that when the handle is rotated, the shaft exterior surface moves along the jack contact arm tip apex and removes corrosion from the jack contact arm tip apex.

2. A cleaning tool for cleaning an electrical jack, the jack having an exterior face and a barrel, the jack barrel having an interior through which an electrical plug is inserted, the jack barrel interior having a diameter, the jack further having a metal contact arm, the jack contact arm having a tip, the jack contact arm tip having two sides forming an apex, the jack contact arm tip apex being in contact with the electrical plug upon insertion, comprising:

(a) a handle;

(b) a flexible, circular shaft, the shaft having a first end attached to the handle, the shaft further having a second end, a length between the shaft first end and the shaft second end, a diameter, and an exterior surface, the shaft diameter being such that the shaft is closely received by the jack barrel, the shaft length being greater than the distance from the jack exterior face to the jack contact arm tip apex; and (c) a tool tip adjacent the shaft second end, the tool tip having a diameter, the tool tip diameter being less than the shaft diameter such that, as the tool tip is inserted in and beyond the jack barrel interior, the tool tip bears upon the jack contact arm tip and displaces the jack contact arm tip -such that the shaft exterior surface moves into contact with the displaced jack contact arm tip, the shaft flexibility also allowing the stiffness of the jack contact arm to bend the shaft, the shaft exterior surface material being such that when the handle is rotated, the shaft exterior surface removes corrosion from the contact arm tip apex.

3. The cleaning tool of claim 2, wherein the tool tip is conically shaped, such that the tool tip and the jack contact arm tip are smoothly displaced during insertion.

4. The cleaning tool of claim 2, the shaft exterior surface material having a coefficient of friction such that, when the handle is rotated along its longitudinal axis, the shaft will move along the jack contact arm tip apex.

5. The cleaning tool of claim 2, the shaft exterior surface material being further such that corrosion removed from the jack contact arm tip apex attaches to the shaft exterior surface.

6. The cleaning tool of claim 2, the shaft exterior surface material being further such that corrosion attached to the jack exterior surface may be removed by wiping the jack exterior surface with alcohol.

7. The cleaning tool of claim 2, wherein the shaft exterior surface material is low density polyethylene.

8. The cleaning tool of claim 2, the shaft being of such material that the force exerted by the bent shaft against the jack contact arm tip apex, is sufficient to remove imbedded corrosion.

9. The cleaning tool of claim 2, wherein the shaft material is low density polyethylene.

10. The cleaning tool of claim 2, wherein the shaft further comprises a core made of a different material than the jack exterior surface material.

11. The cleaning tool of claim 2, wherein the handle has a width, the handle width being greater than the diameter of the jack barrel interior.

12. The cleaning tool of claim 2, wherein the shaft diameter is further sized with respect to the jack barrel interior, such that when the shaft second end is inserted into the jack barrel interior, and the handle is bent with respect to the shaft, the shaft exterior surface bears upon a substantial length of the jack barrel interior.

13. A cleaning tool for cleaning an electrical jack, the jack having an exterior face and a barrel, the jack barrel having an interior through which an electrical plug is inserted, the jack barrel interior having a diameter, the jack further having a plurality of metal contact arms, each of the jack contact arms having a tip, each of the jack contact arm tips having two sides forming an apex, each of the jack contact arm tip apexes being in contact with the electrical plug upon insertion, comprising:

(a) a handle; and (b) a flexible, circular shaft, the shaft having a first end attached to the handle, the shaft further having a second end, a length between the shaft first end and the shaft second end, a diameter, and an exterior surface, the shaft diameter being, such that the shaft is closely received by the jack barrel, the shaft length being greater than the distance from the jack exterior face to the jack contact arm tip apex positioned farthest from the jack exterior face, the shaft exterior surface being made of low density polyethylene, such that, as the shaft second end is inserted in and beyond the jack barrel interior, the shaft second end bears upon each of the jack contact arm tips in turn, and displaces each of the jack contact arm tips, such that the shaft exterior surface moves into contact with each of the displaced jack contact arm tip apexes, the shaft flexibility allowing the stiffness of the jack contact arms to bend the shaft, the shaft exterior surface material being such that when the handle is rotated, the shaft exterior surface removes corrosion from each of the contact arm tip apexes.

14. A cleaning tool for cleaning an electrical jack, the jack having an exterior face and a barrel, the jack barrel having an interior through which an electrical plug is inserted, the jack barrel interior having a diameter, the jack further having a plurality of metal contact arms, each of the jack contact arms having a tip, each of the jack contact arm tips having two sides forming an apex, each of the jack contact arm tip apexes being in contact with the electrical plug upon insertion, comprising:

(a) a handle;

(b) a flexible, circular shaft, the shaft having a first end attached to the handle, the shaft further having a second end, a length between the shaft first end and the shaft second end, a diameter, and an exterior surface, the shaft diameter being such that the shaft is closely received by the jack barrel, the shaft length being greater than the distance from the jack exterior face to the jack contact arm tip apex positioned farthest from the jack exterior face; and (c) a tool tip adjacent the shaft second end, the tool tip having a diameter, the tool tip diameter being less than the shaft diameter such that, as the tool tip is inserted in and beyond the jack barrel interior, the tool tip bears upon each of the jack contact arm tips and displaces each of the jack contact arm tip apexes such that the shaft exterior surface moves into contact with each of the displaced jack contact arm tip apexes, the shaft flexibility allowing the stiffness of the jack contact arms to bend the shaft, the shaft exterior surface material being such that when the handle is rotated, the shaft exterior surface removes corrosion from each of the contact arm tip apexes.

* * * * *